US008511088B2

(12) United States Patent
Imamura et al.

(10) Patent No.: US 8,511,088 B2
(45) Date of Patent: Aug. 20, 2013

(54) GAS TURBINE FUEL INJECTOR MOUNTING SYSTEM

(75) Inventors: Tohru Imamura, Akashi (JP); Hideki Ogata, Kakogawa (JP); Kunio Hidani, Akashi (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 182 days.

(21) Appl. No.: 12/801,855

(22) Filed: Jun. 29, 2010

(65) Prior Publication Data

US 2011/0000216 A1 Jan. 6, 2011

(30) Foreign Application Priority Data

Jul. 6, 2009 (JP) ..... 2009-159452

(51) Int. Cl.
*F02C 7/20* (2006.01)

(52) U.S. Cl.
USPC ..... 60/748; 60/798

(58) Field of Classification Search
USPC ..... 60/752–760, 748, 737, 740, 796, 60/798, 799
See application file for complete search history.

(56) References Cited

U.S. PATENT DOCUMENTS

| | | | | |
|---|---|---|---|---|
| 3,854,285 | A * | 12/1974 | Stenger et al. | 60/756 |
| 3,927,520 | A * | 12/1975 | Arvin et al. | 60/39.23 |
| 4,290,396 | A * | 9/1981 | Urlaub | 123/193.3 |
| 4,525,996 | A * | 7/1985 | Wright et al. | 60/796 |
| 5,577,379 | A | 11/1996 | Johnson | |
| 5,974,805 | A * | 11/1999 | Allen | 60/740 |
| 5,996,335 | A * | 12/1999 | Ebel | 60/800 |
| 6,164,074 | A * | 12/2000 | Madden et al. | 60/752 |
| 6,212,870 | B1 * | 4/2001 | Thompson et al. | 60/772 |
| 6,412,272 | B1 * | 7/2002 | Titterton et al. | 60/39.37 |
| 6,679,063 | B2 * | 1/2004 | Ebel | 60/798 |
| 6,718,770 | B2 * | 4/2004 | Laing et al. | 60/740 |
| 7,673,460 | B2 | 3/2010 | Hernandez et al. | |
| 2006/0207258 | A1 | 9/2006 | Tanner et al. | |
| 2008/0229750 | A1 * | 9/2008 | Sipson | 60/734 |
| 2011/0271684 | A1 * | 11/2011 | Corsmeier et al. | 60/753 |

FOREIGN PATENT DOCUMENTS

| | | |
|---|---|---|
| EP | 1 710 503 A1 | 10/2006 |
| JP | A-2006-266669 | 10/2006 |
| JP | A-2006-343092 | 12/2006 |

OTHER PUBLICATIONS

Extended Search Report issued in European Patent Application No. 10168146.8 dated Jul. 28, 2011.
Office Action issued in Japanese Patent Application No. 2009-159452 dated May 10, 2011 (with translation).

* cited by examiner

*Primary Examiner* — Gerald L Sung
(74) *Attorney, Agent, or Firm* — Oliff & Berridge, PLC

(57) ABSTRACT

A gas turbine combustor, which can enable only a swirler and a heat shield to be readily taken out from the combustor upon the exchange the swirler and the heat shield. The gas turbine combustor includes: a combustion cylinder; a fuel injection unit for supplying fuel to a head portion of the combustion cylinder; a support member configured for allowing the fuel injection unit to be supported by the combustion cylinder; and a heat shield adapted for heat-insulating the support member from combustion gas in the combustion chamber, wherein the fuel injection unit includes a fuel injection valve for injecting the fuel, and a swirler for supplying compressed air to the fuel injected from the fuel injection valve while swirling the compressed air. The swirler and heat shield are connected together, constituting a swirler unit. This swirler unit is detachably attached to the support member via a fastening member.

17 Claims, 6 Drawing Sheets

GAS TURBINE FUEL INJECTOR MOUNTING SYSTEM

CROSS REFERENCE TO RELATED APPLICATIONS

This application is based upon the prior Japanese Patent Application No. 2009-159452 filed on Jul. 6, 2009, the entire contents of which are incorporated herein by reference.

TECHNICAL FIELD

The present invention relates to a combustor for used in a gas turbine and/or airplane jet engine (the combustor is referred to as the "gas turbine combustor" hereinafter).

BACKGROUND ART

In the gas turbine combustor of this type, an annular type one is widely used. Further, as the annular type combustor, the combustor having a certain structure is known, wherein fuel injection valves for injecting the fuel are provided to a head portion of a combustion cylinder, and a swirler adapted for swirling compressed combustion air to stabilize the combustion is attached around an outer circumference of each fuel injection valve, and a support member configured for supporting each swirler in a cowling of the combustion cylinder is heat-insulated from combustion gas in a combustion chamber by a heat shield (Patent Document 1).

REFERENCES OF THE PRIOR ART

Patent Document 1: JP2006-343092A

In the above gas turbine combustor, wear and/or cracks sometimes occur in each swirler by fretting against the fuel injection valve. Further, each heat shield is sometimes partly damaged by the combustion. Therefore, such a swirler and/or heat shield is generally has the shortest life span in the gas turbine combustor. If such damage or defect as described above is found in the swirler and/or heat shield upon the overhaul of the gas turbine combustor, such a damaged or defective component should be immediately exchanged.

However, in the prior art gas turbine combustor as described above, it is not so easy to exchange each swirler and/or heat shield. Namely, the heat shield is fixed by welding to each corresponding support member, while each swirler is attached to such a heat shield in a not detachable manner. Therefore, for the exchange of such a swirler and/or heat shield, it is necessary to cut the support member and/or cowling which support such components. Thus the working efficiency is bad as well as the life span of the support member and/or cowling is short.

Therefore, it is an object of this invention to provide the gas turbine combustor having a significantly improved structure that can enable only the swirler and/or heat shield to be readily removed and exchanged.

SUMMARY OF THE INVENTION

In order to achieve the above object, the gas turbine combustor of the present invention is adapted for combusting the fuel with compressed air supplied from a compressor so as to produce the combustion gas, and then feeding the so-produced combustion gas into a turbine, and includes: the combustion cylinder constituting the combustion chamber; a fuel injection unit adapted for supplying the fuel to the head portion of the combustion cylinder; the support member adapted for supporting the fuel injection unit in the combustion cylinder; and the heat shield adapted for heat-insulating the support member from the combustion gas in the combustion chamber, wherein the fuel injection unit includes the fuel injection valve adapted for injecting the fuel, and the swirler adapted for supplying the compressed air to the fuel injected from the fuel injection valve, while swirling the compressed air, wherein the swirler and heat shield are connected together, thereby constituting a swirler unit, and wherein the swirler unit is detachably attached to the support member via a fastening member.

According to this gas turbine combustor, the swirler unit, which is provided by connecting the swirler and heat shield together, is detachably attached to the support member via the fastening member. Therefore, only the swirler unit can be readily taken out by unfastening the fastening member when the swirler and/or heat shield are exchanged. In addition, unlike the prior art combustor, there is no need for cutting the support member or cowling. Therefore, the intrinsic life span of the support member or cowling can be adequately ensured.

In this invention, it is preferred that the swirler unit has a holding plate adapted for holding the swirler, such that the swirler can be moved in both of radial and circumferential directions, wherein the holding plate can be joined to the heat shield. With this configuration, the swirler unit can absorb or cancel the difference in the thermal expansion between the heat shield and the swirler due to the high temperature combustion gas as well as the dimensional difference therebetween upon assembly, by appropriate movement or shift of the swirler in both of the radial and circumferential directions. This can effectively prevent generation of great thermal stress that may be otherwise exerted on the swirler and/or heat shield, thereby significantly elongating the life span of the two components.

In this invention, the fastening member may include a stud bolt provided to the heat shield and a nut configured to be meshed with the stud bolt. With this configuration, by only meshing and unmeshing the nut relative to the stud bolt, the swirler unit can be readily attached or detached relative to the support member.

In this invention, it is preferred that the stud bolt is inserted through an insertion hole of the support member. With this configuration, even through a quite simple fixing or fastening means, which meshes and fastens the nut with the stud bolt inserted through the insertion hole of the support member, is employed, the swirler unit can be firmly fixed to the support member.

In this invention, it is preferred that the combustion cylinder is of such an annular type that includes an inner liner, an outer liner and the cowling connected with each head portion of these liners, wherein the fastening member is exposed to the outside from an air flow opening formed in an apex of the cowling, such that the fastening member can be accessed from the outside through the air flow opening. With this configuration, the fastening member can be operated as needed by inserting a fastening tool through the existing air flow opening. Therefore, the fastening member can be readily operated without providing an additional opening for the access to the fastening member.

Effect of the Invention

According to the gas turbine combustor of this invention, the swirler unit provided by connecting the swirler and heat shield together is detachably attached to the support member via the fastening member. Therefore, only the swirler unit can be readily taken out by unfastening the fastening member, upon exchanging the swirler and/or heat shield. Further, there is no need for cutting the support member and/or cowling. Therefore, the intrinsic life span of the support member or cowling can be adequately ensured.

DETAILED DESCRIPTION OF THE INVENTION

Hereinafter, preferred embodiments of the present invention will be described with reference to the drawings.

Figure 1:
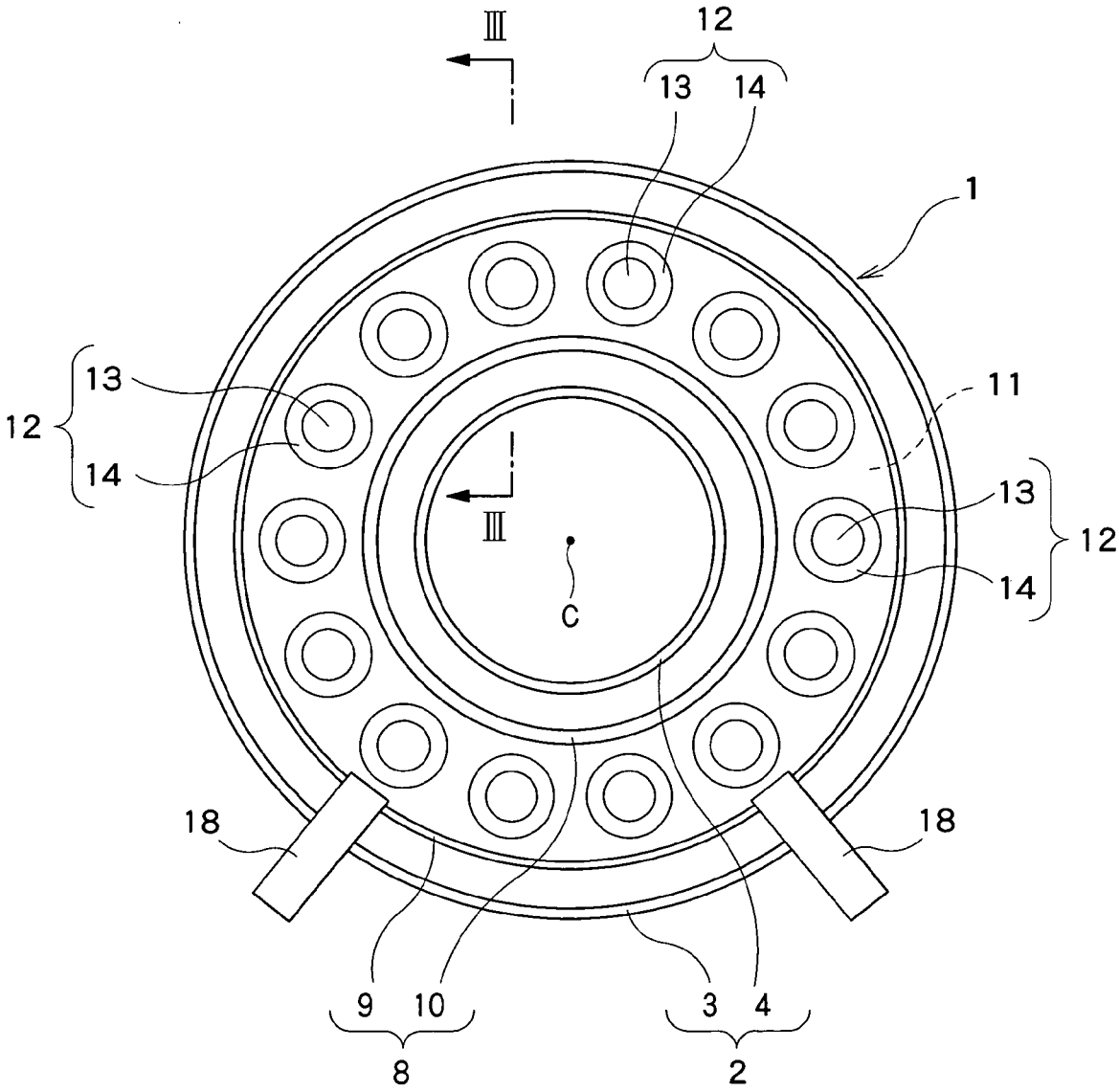
FIG. 1 is a schematic transverse cross section showing the gas turbine combustor related to one embodiment of the present invention.

As shown in FIG. 1, a gas turbine engine is configured to drive a turbine, by combusting a mixed gas produced by mixing a fuel with the compressed air supplied from a compressor (not shown) of the gas turbine engine, and then by feeding the so-produced high-temperature and high-pressure combustion gas, generated by the combustion, to the turbine.

The gas turbine combustor 1 is of an annular type that is concentric with an axis C of the gas turbine engine. In this gas turbine combustor 1, an annular inner casing 4 is concentrically arranged inside an annular outer casing 3. In this case, the annular inner casing 4 and the annular outer casing 3 constitute a housing 2 which has an annular internal space formed therein. In the annular internal space of the housing 2, a combustion cylinder 8 is provided concentrically relative to the housing 2. This combustion cylinder 8 is composed of an annular outer liner 9 and an annular inner liner 10, wherein the inner liner 10 is concentrically located inside the outer liner 9. Further, the combustion cylinder 8 has an annular combustion chamber 11 in the interior thereof. In this case, a plurality of (e.g., 14 to 20) fuel injection units 12, each adapted for injecting the fuel into the combustion chamber 11, are provided to the combustion cylinder 8. In this case, fuel injection units 12 are respectively arranged circumferentially, with an equal interval, in a circular line concentric with the combustion cylinder 8. Each fuel injection unit 12 includes the fuel injection valve 13 adapted for injecting the fuel, and a radial-flow type main swirler 14 provided concentrically with the fuel injection valve 13, while surrounding this fuel injection valve 13, and adapted for introducing the compressed air in a swirled flow condition into the combustion chamber 11. Further, two ignition plugs 18 are arranged at a lower portion of the gas turbine combustor 1.

Figure 3:
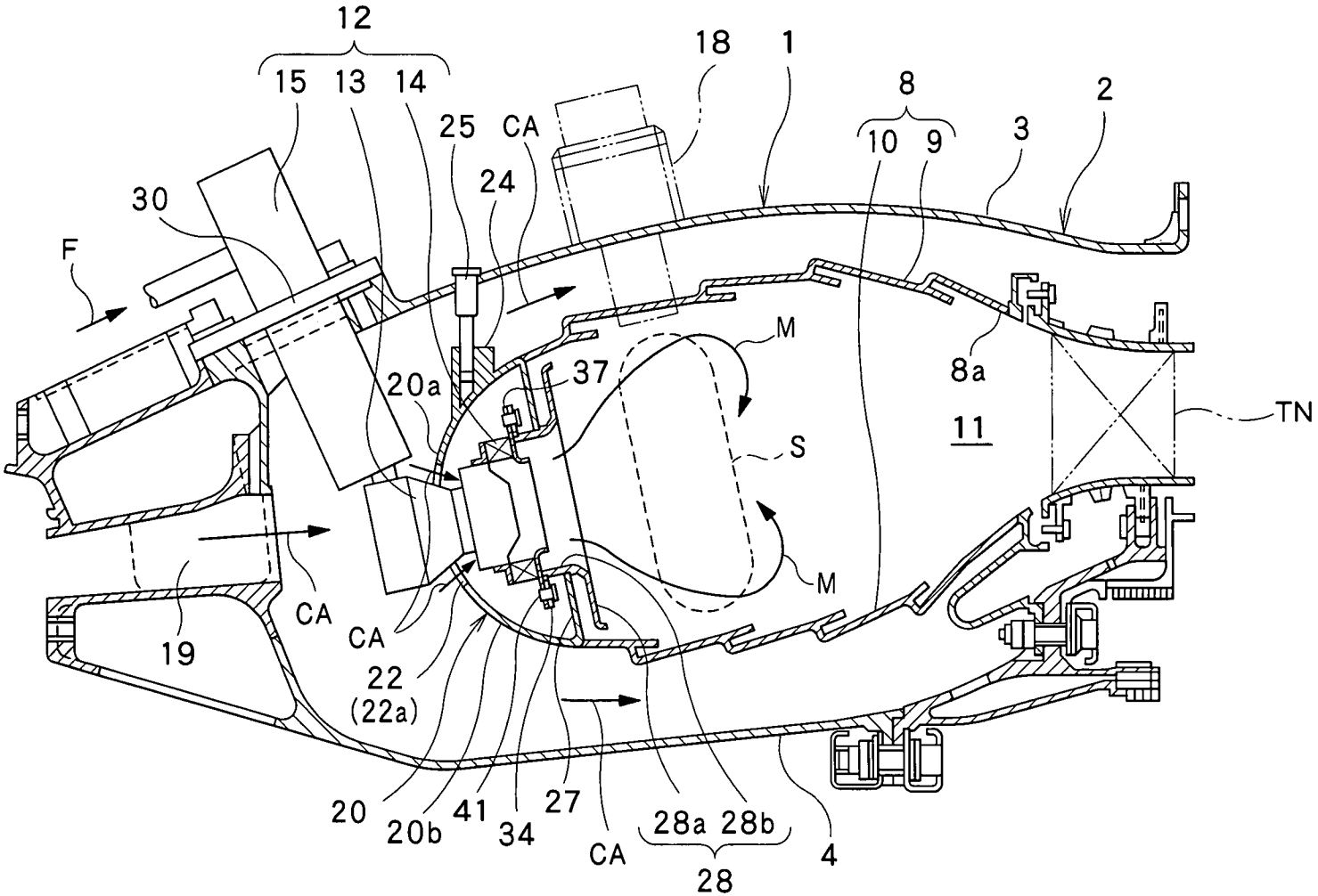
FIG. 3 is an enlarged cross section taken along line depicted in FIG. 1.

In the enlarged cross section of FIG. 3 taken along line in FIG. 1, the compressed air CA supplied from the compressor (not shown) is introduced into the annular internal space of the housing 2 via an annular diffuser 19. Further, an annular cowling 20 is fixed to each head portion of the outer liner 9 and inner liner 10 of the annular combustion cylinder 8, so that the annular cowling 20 is concentric with each of the outer liner 9 and inner liner 10. This cowling 20 is composed of a cowling outer part 20*a* and a cowling inner part 20*b* located inside the cowling outer part 20*a*. In this cowling 20, an air flow opening 22 is provided between the two parts 20*a*, 20*b* for introducing the compressed air CA into the combustion cylinder 8. A plurality of holding cylinders 24 are integrally provided to the cowling outer part 20*a*, such that the combustion cylinder 8 can be fixed to the outer casing 3, by fitting a fixing pin 25 which is inserted from the outside of the outer casing 3 into each holding cylinder 24.

An annular support member 27 (hereinafter referred to as the "dome 27"), which is configured, as will be described later, for supporting each fuel injection valve 12, is integrally provided to a rear end portion of the cowling 20. Namely, the cowling 20 and dome 27 are provided as a single casted body. Alternatively, however, the cowling 20 and dome 27 may be provided as separated members that can be joined together, such as by welding or the like. Proper heat shields 28 are respectively fixed to the dome 27, in order to heat-insulate the dome 27 from the combustion gas in the combustion chamber 11. Each heat shield 28 includes a plate-like shield main body 28*a* and a cylindrical part 28*b*. This cylindrical part 28*b* extends toward the upstream side of the fuel injection unit 12 from the periphery of an opening formed in the main body 28*a*. Namely, each heat shield 28 is supported by the dome 27 via the cylindrical body 28*b* thereof.

Each fuel injection unit 12 includes a stem 15 having a fuel pipe inserted therethrough, wherein the fuel injection valve 13 is connected with a distal end of the stem 15. Each main swirler 14 is provided to introduce the compressed air CA, in the radial direction, from the outside to the inside thereof. Each main swirler 14 is supported by each corresponding heat shield 28 via a holding plate 34. It is noted that the structure for supporting each main swirler 14 will be discussed later. In each fuel injection unit 12, the fuel injection valve 13 is fitted in the main swirler 14, while being inserted through the swirler 14 from the air flow opening 22 formed in the apex of the cowling 20. Meanwhile, the stem 15 is supported by the outer casing 3 via each corresponding attachment flange 30. In addition, a downstream end 8*a* of the combustion cylinder 8 is connected with a first stage-nozzle TN of the turbine.

Figure 2:
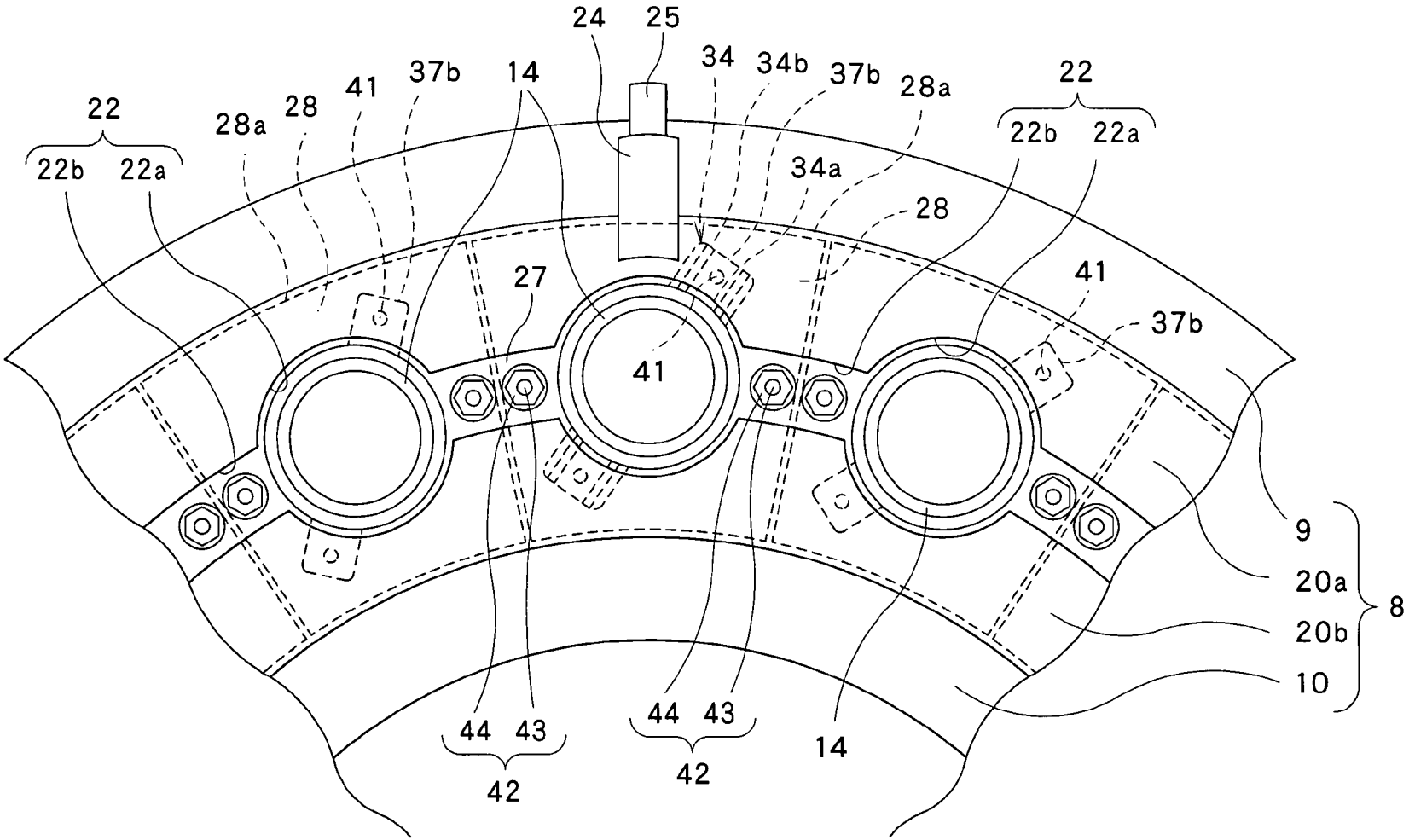
FIG. 2 is an enlarged front view showing a part of the combustion cylinder of the gas turbine combustor shown in FIG. 1.

As shown in the enlarged front view of FIG. 2, the air flow opening 22 formed in the apex of the cowling 20 is composed of circular openings 22*a*, each provided to be opposed to each corresponding main swirler 14, and arcuate openings 22*b*, each configured to communicate two adjacent circular openings 22*a* together. Each heat shield 28 is located on the back side of each corresponding main swirler 14. In this case, each heat shield 28 is opposed to each corresponding main swirler 14. Between two substantially trapezoidal shield main bodies 28*a*, 28*a* of the respective two adjacent heat shields 28, a predetermined interval or space (e.g., 1 mm) is provided.

Figure 4:
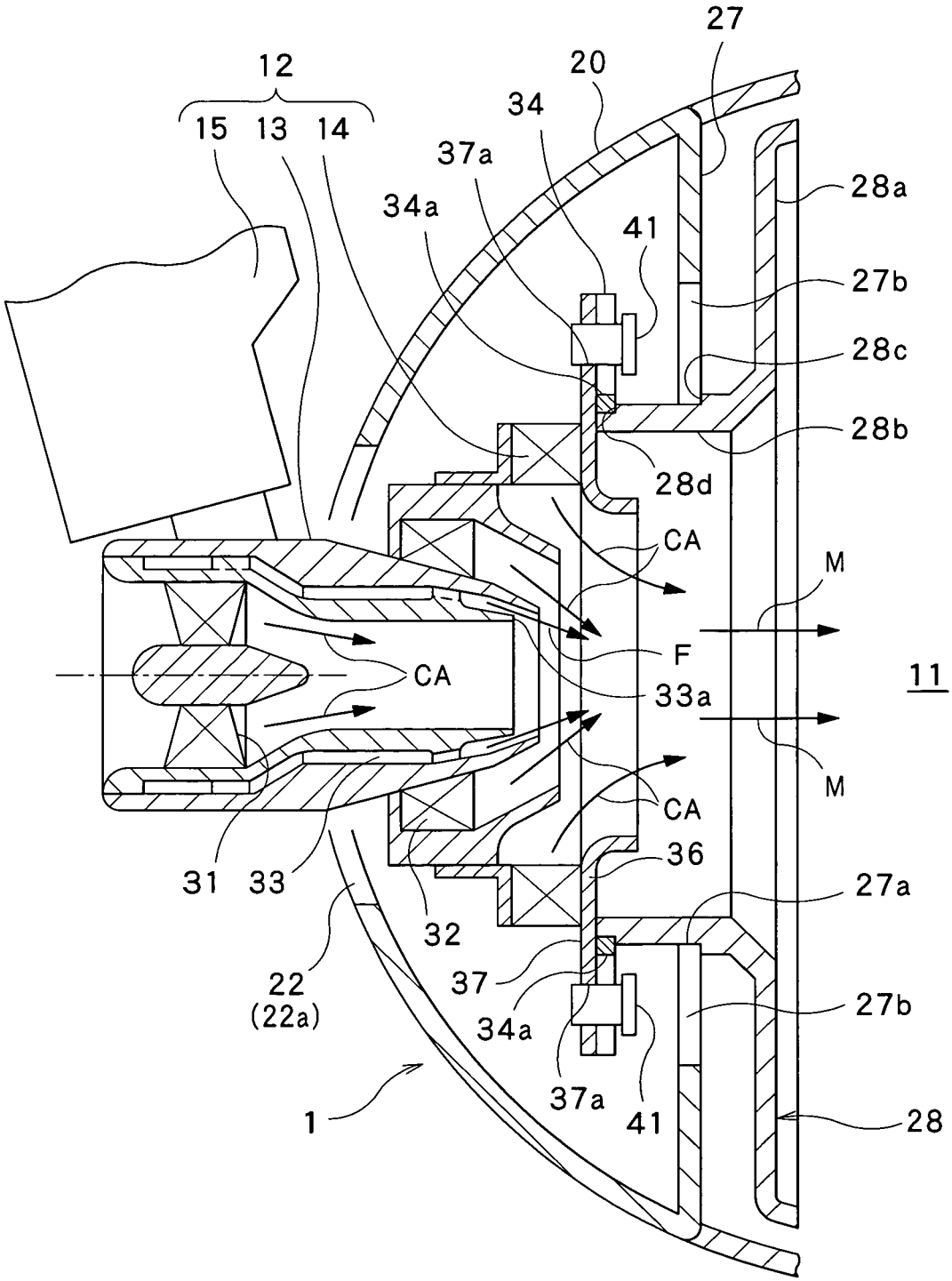
FIG. 4 is an enlarged view showing a key portion shown in FIG. 3.

In the enlarged view of FIG. 4 showing the key portion depicted in FIG. 3, the fuel injection valve 13 of each fuel injection unit 12 has a central inner swirler 31 and an outer swirler 32 externally provided around the outer circumference of the inner swirler 31, wherein an annular fuel flow passage 33 is provided between respective air flow passages of the two swirlers 31, 32 for introducing the fuel F supplied from the fuel pipe of the stem 15 into the combustion chamber 11. Thus, the fuel F can be injected into the combustion chamber 11 from injection ports 33*a* which are respectively arranged at a distal end of the fuel flow passage 33, with an equal interval in the circumferential direction. In this case, the fuel F, once injected from each injection port 33*a*, is changed into fine particles by the swirled flow of the compressed air CA supplied from the inner and outer swirlers 31, 32. And then, the fuel F is formed into the mixed gas M together with the compressed air CA. Thereafter, the so-formed mixed gas M is supplied into the combustion chamber 11. Thus, each fuel injection unit 12 is provided as a diffusion-combustion-type injection unit. Further, in this case, the swirled flow of the compressed air CA supplied from each main swirler 14 is utilized for controlling the size and position of a backflow region of the mixed gas M, in order to suitably set a combustion region S (see FIG. 3).

Each heat shield 28 further includes a large diameter step portion 28*c* which is provided around an outer circumferential face of the cylindrical part 28*b* thereof. This large diameter step portion 28*c* is configured to be in contact with an inner circumferential end of each corresponding holding aperture 27*a* of the dome 27, thereby positioning the heat shield 28 relative to the dome 27. Further, each heat shield 28 has a small diameter step portion 28*d* which is provided at an opening end of the cylindrical part 28*b* thereof. This small diameter step portion 28*d* is configured to be in contact with an inner circumferential end of each corresponding ring-like holding plate 34, thereby allowing the holding plate 34 to be fixed to the heat shield 28 by welding.

A downstream end wall 36 of each main swirler 14 (i.e., a wall of the main swirler 14 located on the downstream side in the combustion cylinder) is formed into an attachment plate 37 extending radially outward. This attachment plate 37 has two pin holes 37*a* formed therein, wherein two pin holes 37*a* are opposed, by 180°, relative to each other. Meanwhile, the holding plate 34 has a pair of recesses 34*a* respectively opened in outer circumferential edges of the plate 34. In addition, an attachment pin 41 which is inserted through each recess 34*a*, is fitted into each corresponding pin hole 37*a* and fixed to the attachment plate 37 by welding. As shown FIG. 5, each recess 34*a* of the holding plate 34 has a circumferential width W and a depth H. In this case, the circumferential width W and the depth H are respectively greater than the outer diameter of each attachment pin 41. Accordingly, each main swirler 14 is supported by each corresponding holding plate 34, such that this swirler 14 can be displaced, relative to the holding plate 34, in both of the circumferential and radial directions. With this configuration, the difference in the coefficient of thermal expansion between the heat shield 28 and the main swirler 14 due to the high temperature combustion gas, and the dimensional difference therebetween upon assembly can be successfully cancelled or absorbed.

When assembled, the main swirler 14 and holding plate 34 are overlapped with each other. Each recess 34*a* of the holding plate 34 is formed in a holding piece 34*b* which is projected radially outward from the holding plate 34 in a position corresponding to each attachment plate 37 of the main swirler 14. Meanwhile, a pin hole 37*a* is formed in each flange 37*b* of the attachment plate 37, each flange 37*b* being provided in a position corresponding to each holding piece 34*b*. Namely, in such a relative position that the respective holding pieces 34*b* and flanges 37*b* are overlapped with one another, the holding plate 34 and attachment plate 37 can be connected with each other via the respective attachment pins 41.

Each holding aperture 27*a* of the dome 27 is provided to have a diameter slightly larger than each outer diameter of the main swirler 14 and holding plate 34. In this case, this aperture 27*a* does not permit the attachment pieces 34*b* and attachment plates 37, respectively overlapped with one another, to be inserted therethrough. While, a pair of recesses 27*b* are provided around the periphery of each holding aperture 27*a* of the dome 27, so that the pair of recesses 27*b* are located at two radially opposite points, wherein each recess 27*b* extends radially outward in communication with the holding aperture 27*a*. In this case, each recess 27*b* has a shape for allowing each holding piece 34*b* to be inserted therethrough together with each corresponding attachment plate 37.

By the way, in the prior art gas turbine combustor of this type, each heat shield 28 is fixed, by welding, to the dome 27 which is integrated with or fixed to the cowling 20. In turn, each holding plate 34 is fixed, by welding, to the heat shield 28. In addition, each main swirler 14 is connected with the holding plate 34, such that this swirler 14 can be moved or displaced, relative to the holding plate 34, in both of the circumferential and radial directions. Meanwhile, in this embodiment, as shown in the exploded perspective view of FIG. 5, each swirler unit 40 is prepared in advanced by connecting each main swirler 14 to each corresponding heat shield 28 via each holding plate 34. Namely, in this swirler unit 40, the holding plate 34, which is already fixed to the heat shield 28 by welding, is further fixed to the attachment plate 37 of the main swirler 14 by welding via each corresponding attachment pin 41.

In order to detachably attach each swirler unit 40 to the dome 27, two stud bolts 43 are respectively provided integrally at two points which are located opposite to each other and concentrically with the axis C of the combustor (see FIG. 1), on both sides in the width direction of each heat shield 28. In addition, in the vicinity of each holding aperture 27*a* of the dome 27, two insertion holes 27*c* are formed in positions respectively corresponding to the stud bolts 43 so as to allow the stud bolts 43 to be inserted therethrough. With this configuration, by meshing a nut 44 with each stud bolt 43 inserted through the corresponding insertion hole 27*c*, each swirler unit 40 can be detachably fixed to the dome 27. In this way, each stud bolt 43 and each corresponding nut 44 constitute together each fastening member 42 provided for detachably attaching each swirler unit 40 to the dome 27. At an intermediate portion of each stud bolt 43, a step portion 43*b* is provided to be in contact with an edge of each insertion hole 27*c* of the dome 27. Further, a thread 43*a* is formed in a small diameter portion of each stud bolt 43 on the distal end side thereof relative to the step portion 43*b*, while a cylindrical spacer portion 43*c* is provided to a large diameter portion of the stud bolt 43 on the proximal end side thereof relative to the step portion 43*b*.

Figure 5:
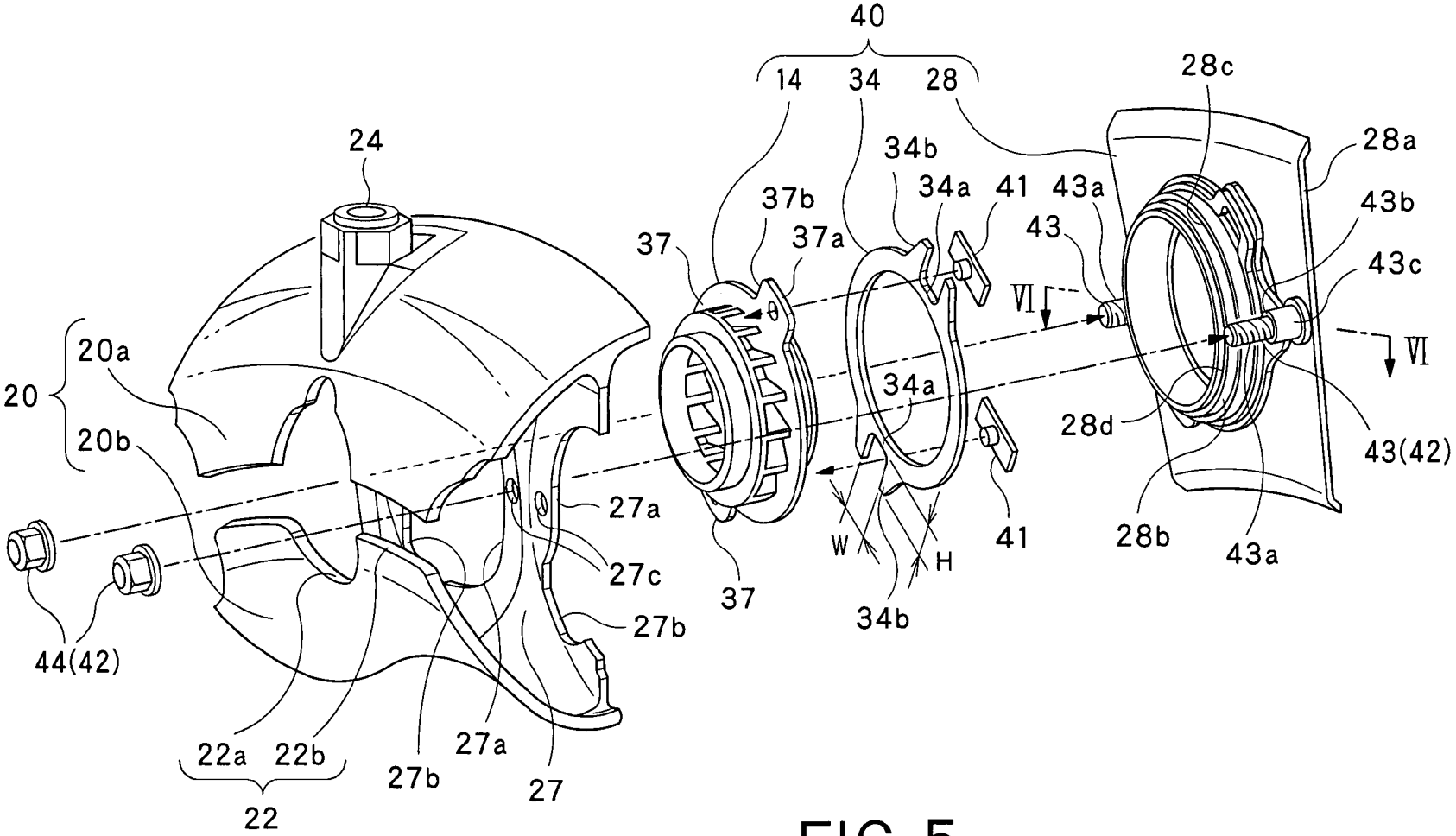
FIG. 5 is an exploded perspective view of the key portion shown in FIG. 4.
Figure 6:
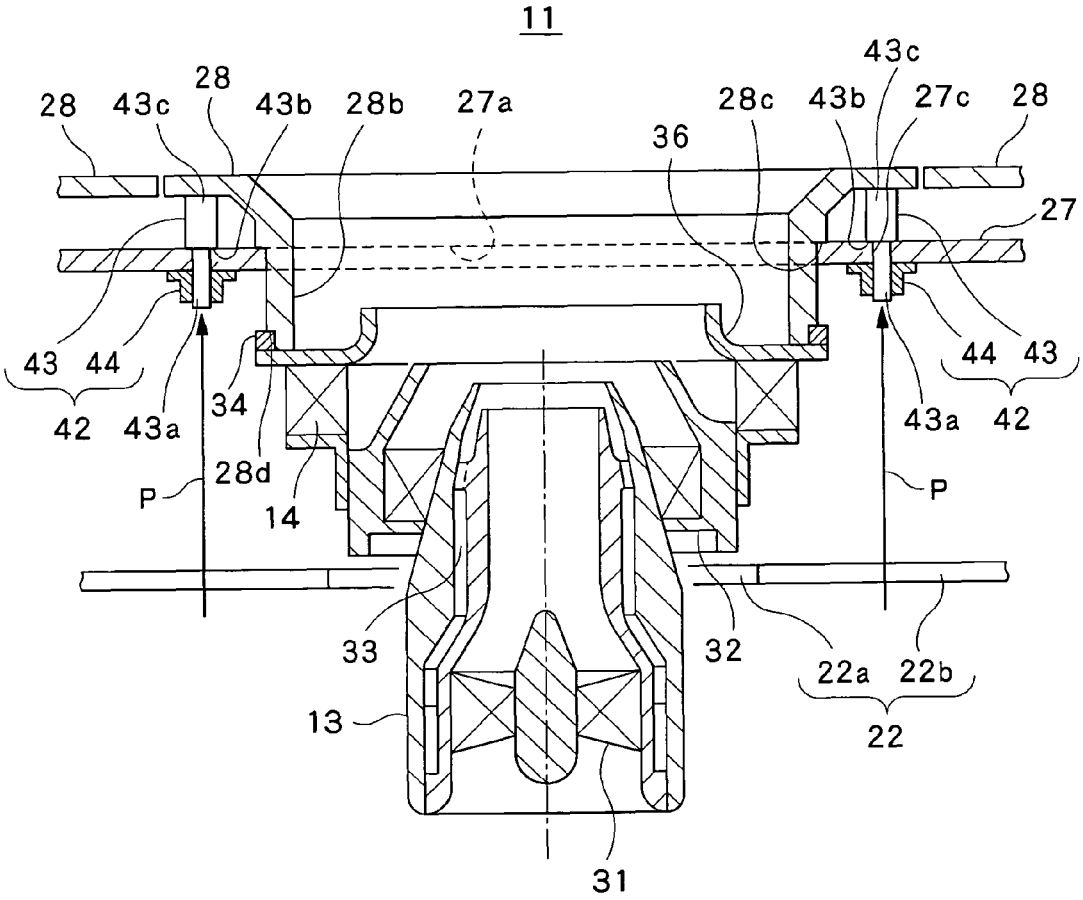
FIG. 6 is an enlarged transverse cross section taken along line VI-VI depicted in FIG. 5.

Each swirler unit 40 is detachably attached to the dome 27 in the following procedure. First, as shown in FIG. 5, the main swirler 14 is inserted through the holding aperture 27*a* from the back side (i.e., the right side in FIG. 5) of the dome 27. At this time, the flanges 37*b* of the attachment plate 37 of the main swirler 14 and the holding pieces 34*b* of the holding plate 34 are inserted together through the recesses 27*b* of the dome 27, respectively. Thereafter, the threads 43*a* of the pair of stud bolts 43 are inserted through the insertion holes 27*c* of the dome 27, respectively. In this way, as shown in FIG. 4, the large diameter step portion 28*c* of the heat shield 28 is brought into contact with the edge portion of the holding aperture 27*a* of the dome 27. In this case, as shown in FIG. 6, i.e., the transverse cross section view which is taken along line VI-VI in FIG. 5, the large diameter step portion 28*c* of the heat shield 28 is in contact with the circumferential edge of the holding aperture 27*a* of the dome 27, while the step portion 43*b* of each stud bolt 43 is in contact with the edge of each insertion hole 27*c* of the dome 27. Consequently, the heat shield 28 and dome 27 are held together, with an interval provided therebetween, corresponding to the length of the spacer portion 43*c* of each stud bolt 43.

As shown in FIG. 2, the thread 43*a* of each stud bolt 43 is located on the back side of each corresponding arcuate opening 22*b* of the air flow opening 22 of the cowling 20, so that the thread 43*a* is opposed to the arcuate opening 22*b*. With this configuration, a fastening tool can access each nut 44 through the arcuate opening 22*b*. Then, as shown by each arrow P depicted in FIG. 6, the fastening tool for fastening each nut 44 can be inserted in the cowling 20 from the arcuate opening 22*b*, so that the nut 44 can be meshed and fastened with the thread 43*a* of each corresponding stud bolt 43. In this way, each swirler unit 40 can be detachably attached to the dome 27.

If some defect, such as the wear, cracks or other like partly damaged portions, is found in the main swirler 14 or heat shield 28 upon the overhaul of the gas turbine combustor 1, as shown in FIG. 2, upon exchanging such a defective component, each nut 44 can be visually confirmed through each corresponding arcuate opening 22*b* of the air flow opening 22 from the front side of the combustion cylinder 8. Therefore, as shown by each arrow P depicted in FIG. 6, each nut 44 can be unfastened and removed by inserting the fastening tool toward the nut 44 from the arcuate opening 22*b*. At this time, as shown in FIG. 6, although the fuel injection valve 13 of each fuel injection unit 12 is inserted in each circular opening 22*a* of the air flow opening 22, the use of the fastening tool is not hindered, in any way, in each arcuate opening 22*b*. Therefore, the removal of each nut 44 can be readily performed. After such removal of the nuts 44, the swirler unit 40 is movable backward (or upward in FIG. 6). Thus, the swirler unit 40 can be moved away from the dome 27 into the combustion chamber 11 while the flanges 37*b* of the main swirler 14 and the holding pieces 34*b* of the holding plate 34 are moved together through the recess 27*b* of the dome 27 (see FIG. 5). Finally, the so-removed swirler unit 40 can be taken out from an opening of the downstream end 8*a* of the combustion cylinder 8 shown in FIG. 3.

As described above, in the gas turbine unit 1, each swirler unit 40 is first formed, by connecting each main swirler 14 with each corresponding heat shield 28, as shown in FIG. 5, and then the so-formed swirler unit 40 is detachably attached to the dome 27 via each fastening member 42. Thus, in case of exchanging each main swirler 14 and/or heat shield 28, only the swirler unit 40 of interest can be taken out by unfastening and removing each nut 44 of the corresponding fastening member 42. Therefore, unlike the prior art system, there is no need for cutting the dome and/or cowling. Thus, the work for exchanging the swirler and/or heat shield can be significantly facilitated, as well as the time required for such work can be substantially reduced. Therefore, the working efficiency can be securely enhanced, as well as the intrinsic life span of the dome 27 and/or cowling 20 can be adequately maintained, thereby significantly reducing the life-cycle cost.

Further, in each swirler unit 40, the difference in the thermal expansion between the heat shield 28 and the main swirler 14 due to the high temperature combustion gas as well as the dimensional difference therebetween upon assembly can be successfully cancelled or absorbed by the holding plate 34 which is joined to the heat shield 28. Thus, the life span of the main swirler 14 and heat shield 28 can be adequately elongated. In addition, each swirler unit 40 can be securely fixed to the dome 27, by meshing and fastening each nut 44 with the thread 43*a* of each stud bolt 43 which is inserted through each corresponding insertion hole 27*c* of the dome 27. Furthermore, the configuration of such an annular type gas turbine combustor 1, as discussed by way of example in this embodiment, can allow each fastening member 42 to be visually confirmed from the outside through each corresponding arcuate opening 22*b* of the air flow opening 22 which is provided at the apex of the cowling 20. Thus, the work for unfastening each nut 44 of the fastening member 42 can be performed by inserting the fastening tool from the corresponding arcuate opening 22*b*. Therefore, there is no need for separately providing an additional hole or opening for accessing each fastening member 42 of interest.

In the above embodiment, although the annular type combustor has been shown and described by way of example, this invention can also be applied to the backflow-cylinder-type combustor. Further, this invention is not limited by what has been particularly shown and described herein. Namely, various additions, alterations and deletions can be made to the above embodiment, without departing from the gist and scope of this invention. In addition, it should be construed that such modifications are all within the scope of this invention.

The invention claimed is:

1. A gas turbine combustor adapted for combusting fuel with compressed air supplied from a compressor so as to produce combustion gas and then feeding the so-produced combustion gas into a turbine, the combustor comprising: a combustion cylinder constituting a combustion chamber; a fuel injection unit adapted for supplying the fuel to a head portion of the combustion cylinder; a support member configured for supporting the fuel injection unit in the combustion cylinder; and a heat shield adapted for heat-insulating the support member from the combustion gas in the combustion chamber, wherein the fuel injection unit includes a fuel injection valve adapted for injecting the fuel, and a swirler adapted for supplying the compressed air to the fuel injected form the fuel injection valve while swirling the compressed air, wherein the swirler and the heat shield are connected together by a connecting member, wherein the connected swirler and the heat shield constitute a swirler unit, and wherein the swirler unit is detachably attached to the support member via a fastening member, and wherein, during assembly of the combustor, the swirler unit is mounted axially downstream from a direction of the support member, and the heat shield is mounted downstream from the swirler.

2. The gas turbine combustor according to claim 1, wherein the swirler unit has a holding plate adapted for holding the swirler, such that the swirler can be moved in both of radial and circumferential directions, and wherein the holding plate can be joined to the heat shield.

3. The gas turbine combustor according to claim 1, wherein the fastening member includes a stud bolt provided at the heat shield and a nut configured to be meshed with the stud bolt.

4. The gas turbine combustor according to claim 2, wherein the fastening member includes a stud bolt provided at the heat shield and a nut configured to be meshed with the stud bolt.

5. The gas turbine combustor according to claim 3, wherein the stud bolt is inserted through an insertion hole of the support member.

6. The gas turbine combustor according to claim 4, wherein the stud bolt is inserted through an insertion hole of the support member.

7. The gas turbine combustor according to claim 1, wherein the combustion cylinder is of an annular type including an inner liner, an outer liner and a cowling connected with each head portion of these liners, and wherein the fastening member is exposed to the outside from an air flow opening formed in an apex of the cowling, such that the fastening member can be accessed from the outside through the air flow opening.

8. The gas turbine combustor according to claim 2, wherein the combustion cylinder is of an annular type including an inner liner, an outer liner and a cowling connected with each head portion of these liners, and wherein the fastening member is exposed to the outside from an air flow opening formed in an apex of the cowling, such that the fastening member can be accessed from the outside through the air flow opening.

9. The gas turbine combustor according to claim 3, wherein the combustion cylinder is of an annular type including an inner liner, an outer liner and a cowling connected with each head portion of these liners, and wherein the fastening member is exposed to the outside from an air flow opening formed in an apex of the cowling, such that the fastening member can be accessed from the outside through the air flow opening.

10. The gas turbine combustor according to claim 4, wherein the combustion cylinder is of an annular type including an inner liner, an outer liner and a cowling connected with each head portion of these liners, and wherein the fastening member is exposed to the outside from an air flow opening formed in an apex of the cowling, such that the fastening member can be accessed from the outside through the air flow opening.

11. The gas turbine combustor according to claim 5, wherein the combustion cylinder is of an annular type including an inner liner, an outer liner and a cowling connected with each head portion of these liners, and wherein the fastening member is exposed to the outside from an air flow opening formed in an apex of the cowling, such that the fastening member can be accessed from the outside through the air flow opening.

12. The gas turbine combustor according to claim 6, wherein the combustion cylinder is of an annular type including an inner liner, an outer liner and a cowling connected with each head portion of these liners, and wherein the fastening member is exposed to the outside from an air flow opening formed in an apex of the cowling, such that the fastening member can be accessed from the outside through the air flow opening.

13. A gas turbine combustor adapted for combusting fuel with compressed air supplied from a compressor so as to produce combustion gas and then feeding the so-produced combustion gas into a turbine, the combustor comprising:

a combustion cylinder constituting a combustion chamber;

a fuel injection unit adapted for supplying the fuel to a head portion of the combustion cylinder;

a support member configured for supporting the fuel injection unit in the combustion cylinder; and a heat shield adapted for heat-insulating the support member from the combustion gas in the combustion chamber, wherein the fuel injection unit includes a fuel injection valve adapted for injecting the fuel, and a swirler adapted for supplying the compressed air to the fuel injected from the fuel injection valve while swirling the compressed air, wherein the swirler and the heat shield are connected together, thereby constituting a swirler unit, wherein the swirler unit is detachably attached to the support member via a fastening member, and wherein the swirler unit is provided so that only the swirler unit can be detached while the fuel injection valve is fixed.

14. The gas turbine combustor according to claim 13, wherein the swirler unit has a holding plate adapted for holding the swirler, such that the swirler can be moved in both radial and circumferential directions, and wherein the holding plate can be joined to the heat shield.

15. The gas turbine combustor according to claim 13, wherein the fastening member includes a stud bolt provided at the heat shield and a nut configured to be meshed with the stud bolt.

16. The gas turbine combustor according to claim 15, wherein the stud bolt is inserted through an insertion hole of the support member.

17. The gas turbine combustor according to claim 13, wherein the combustion cylinder is of an annular type including an inner liner, an outer liner and a cowling connected with each head portion of these liners, and wherein the fastening member is exposed to the outside from an air flow opening formed in an apex of the cowling, such that the fastening member can be accessed from the outside through the air flow opening.

* * * * *